US005713298A

United States Patent [19]

Geuy, Jr. et al.

[11] Patent Number: 5,713,298

[45] Date of Patent: Feb. 3, 1998

[54] ANCHOR HAVING RELEASE CAPABILITIES

[76] Inventors: Carl E. Geuy, Jr.; James M. Rainey, both of 16641 Shinedale Dr., Canyon Country, Calif. 91351

[21] Appl. No.: 804,837

[22] Filed: Feb. 24, 1997

[51] Int. Cl.[6] ..... B63B 21/30

[52] U.S. Cl. ..... 114/298

[58] Field of Search ..... 114/294, 297, 114/298, 299; D12/215

[56] References Cited

U.S. PATENT DOCUMENTS

| | | | |
|---|---|---|---|
| 2,980,050 | 4/1961 | Murray | 114/298 |
| 3,138,134 | 6/1964 | Botine | 114/298 |
| 3,397,665 | 8/1968 | Lindly | 114/298 |

*Primary Examiner*—Ed L. Swinehart

[57] ABSTRACT

An anchor having release capabilities including a cylindrical housing having a plurality of equidistantly spaced vertical slots therein. A central post slidably extends through the cylindrical housing. Free ends of the central post have cable eyes disposed thereon. A plurality of pivoting prongs extend inwardly of the plurality of vertical slots of the cylindrical housing for pivotal securement to the central post. A main line has a free end secured to one of the cable eyes of the central post. An opposing free end of the main line is adapted for coupling to a boat. A secondary line has a first end coupled to one of the cable eyes of the central post opposed from the main line. A second end of the secondary monofilament line is secured to the main line. Once ample force is applied, the secondary line will brake thereby releasing the central post. The central post will then slide down causing the prongs to retract within the recesses thereby releasing the anchor from an obstruction.

7 Claims, 3 Drawing Sheets 16
18
32
48
40
14
28
30
36
44
46
42
20
12
14
16
18
24
26

ANCHOR HAVING RELEASE CAPABILITIES

BACKGROUND OF THE INVENTION

1. Field of the Invention

The present invention relates to an anchor having release capabilities and more particularly pertains to allowing the anchor to be recovered should it become snagged or wedged on a bottom of a lake and the like with an anchor having release capabilities.

2. Description of the Prior Art

The use of anchoring apparatuses is known in the prior art. More specifically, anchoring apparatuses heretofore devised and utilized for the purpose of releasing from a ground surface are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,054,416 to Zetah discloses a boat anchor with fluke release and reset mechanism.

U.S. Pat. No. 4,951,593 to Brown et al. discloses an anchor with snag release mechanics.

U.S. Pat. No. 5,095,842 to Soules discloses a collapsible anchor having releasable flukes.

U.S. Pat. No. 4,380,207 to Nolt discloses an anchoring apparatus.

U.S. Pat. No. Des. 306,424 to Bruce discloses the ornamental design for an anchor.

U.S. Pat. No. 4,579,077 to Soules discloses a collapsible anchor having releasable flukes.

While these devices fulfill their respective, particular objective and requirements, the aforementioned patents do not describe an anchor having release capabilities for allowing the anchor to be recovered should it become snagged or wedged on a bottom of a lake and the like.

In this respect, the anchor having release capabilities according to the present invention substantially departs from the conventional concepts and designs of the prior art, and in doing so provides an apparatus primarily developed for the purpose of allowing the anchor to be recovered should it become snagged or wedged on a bottom of a lake and the like.

Therefore, it can be appreciated that there exists a continuing need for new and improved anchor having release capabilities which can be used for allowing the anchor to be recovered should it become snagged or wedged on a bottom of a lake and the like. In this regard, the present invention substantially fulfills this need.

SUMMARY OF THE INVENTION

In the view of the foregoing disadvantages inherent in the known types of anchoring apparatuses now present in the prior art, the present invention provides an improved anchor having release capabilities. As such, the general purpose of the present invention, which will be described subsequently in greater detail, is to provide a new and improved anchor having release capabilities and method which has all the advantages of the prior art and none of the disadvantages.

To attain this, the present invention essentially comprises a cylindrical housing having open end portions. Each of the open end portions have a rounded end cap removably coupled therewith. Each of the end caps have an aperture therethrough. The cylindrical housing has three equidistantly spaced vertical slots therein. The device includes a central post having a length greater than a length of the cylindrical housing. The central post slidably extends through the apertures of the end caps. Free ends of the central post have cable eyes disposed thereon. The central post has a three way bracket secured thereto. The three way bracket has tabs extending outwardly towards corresponding vertical slots of the cylindrical housing. The tabs each have an aperture therethrough. The device includes three pivoting prongs each having an interior portion and an exterior portion. Each interior portion has an inner segment and an outer segment whereby the inner segment is angularly disposed with respect to the outer segment. The inner segment of each prong extends inwardly of the three vertical slots of the cylindrical housing. The inner segment has an aperture therethrough for aligning with the apertures of the tabs of the three way bracket for pivotal securement thereto. The exterior portion is defined by an elongated arcuate member having a plurality of ridges disposed on its lower surface. A main line is included having a free end secured to one of the cable eyes of the central post. An opposing free end of the main line is adapted for coupling to a boat. A secondary monofilament line is included having a first end coupled to one of the cable eyes of the central post opposed from the main line. A second end of the secondary monofilament line is secured to the main line.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved anchor having release capabilities which has all the advantages of the prior art anchoring apparatuses and none of the disadvantages.

It is another object of the present invention to provide a new and improved anchor having release capabilities which may be easily and efficiently manufactured and marketed.

It is a further object of the present invention to provide a new and improved anchor having release capabilities which is of durable and reliable construction.

An even further object of the present invention is to provide a new and improved anchor having release capabilities which is susceptible of a low cost of manufacture with regard to both materials and labor, and which accordingly is then susceptible of low prices of sale to the consuming public, thereby making such an anchor having release capabilities economically available to the buying public.

Even still another object of the present invention is to provide a new and improved anchor having release capabilities for allowing the anchor to be recovered should it become snagged or wedged on a bottom of a lake and the like.

Lastly, it is an object of the present invention to provide a new and improved anchor having release capabilities including a cylindrical housing having a plurality of equidistantly spaced vertical slots therein. A central post slidably extends through the cylindrical housing. Free ends of the central post have cable eyes disposed thereon. A plurality of pivoting prongs extend inwardly of the plurality of vertical slots of the cylindrical housing for pivotal securement to the central post. A main line has a free end secured to one of the cable eyes of the central post. An opposing free end of the main line is adapted for coupling to a boat. A secondary line has a first end coupled to one of the cable eyes of the central post opposed from the main line. A second end of the secondary monofilament line is secured to the main line. Once ample force is applied, the secondary line will brake thereby releasing the central post. The central post will then slide down causing the prongs to retract within the recesses thereby releasing the anchor from an obstruction.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
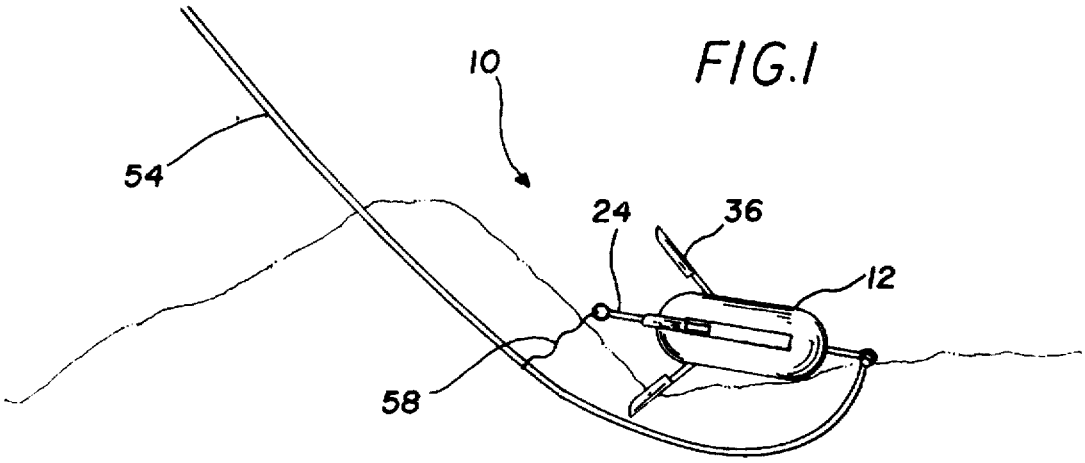
FIG. 1 is a perspective view of the preferred embodiment of the anchor having release capabilities constructed in accordance with the principles of the present invention.
Figure 2:
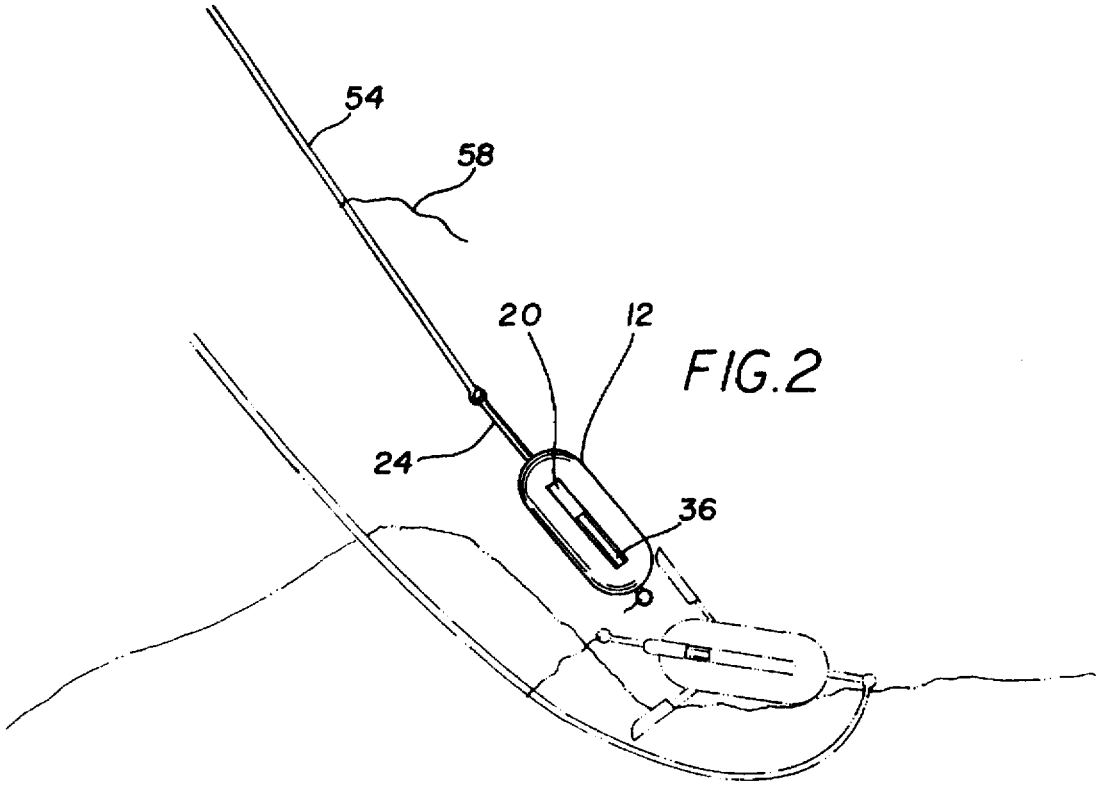
FIG. 2 is a perspective view of the present invention illustrated in a retracted orientation.
Figure 3:
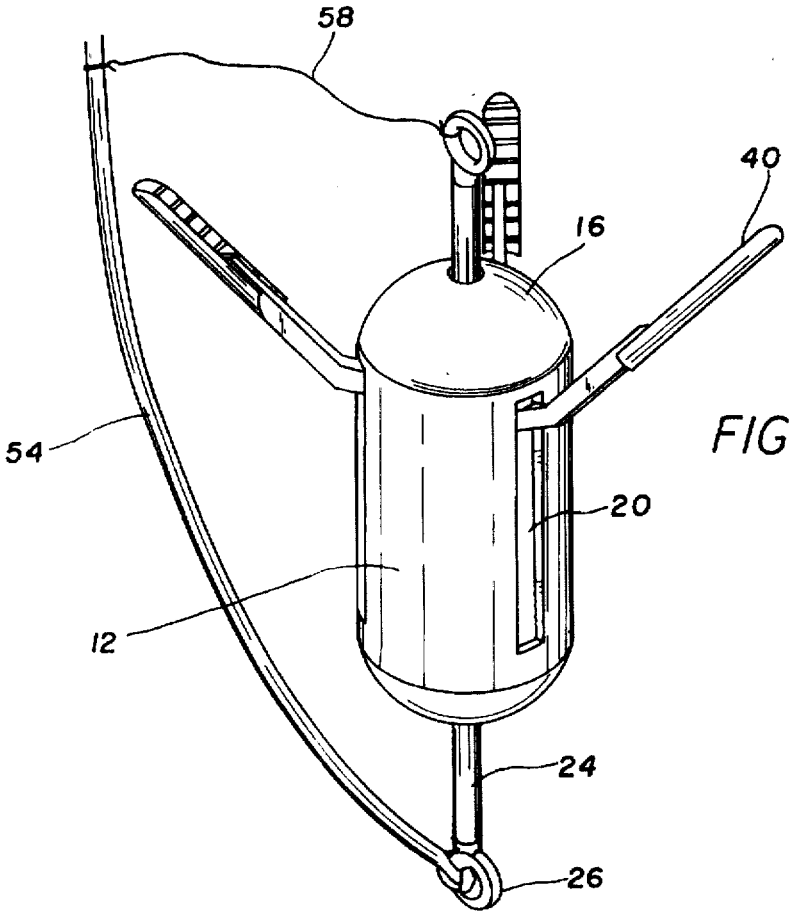
FIG. 3 is a plan perspective view of the present invention in an extended orientation.
Figure 4:
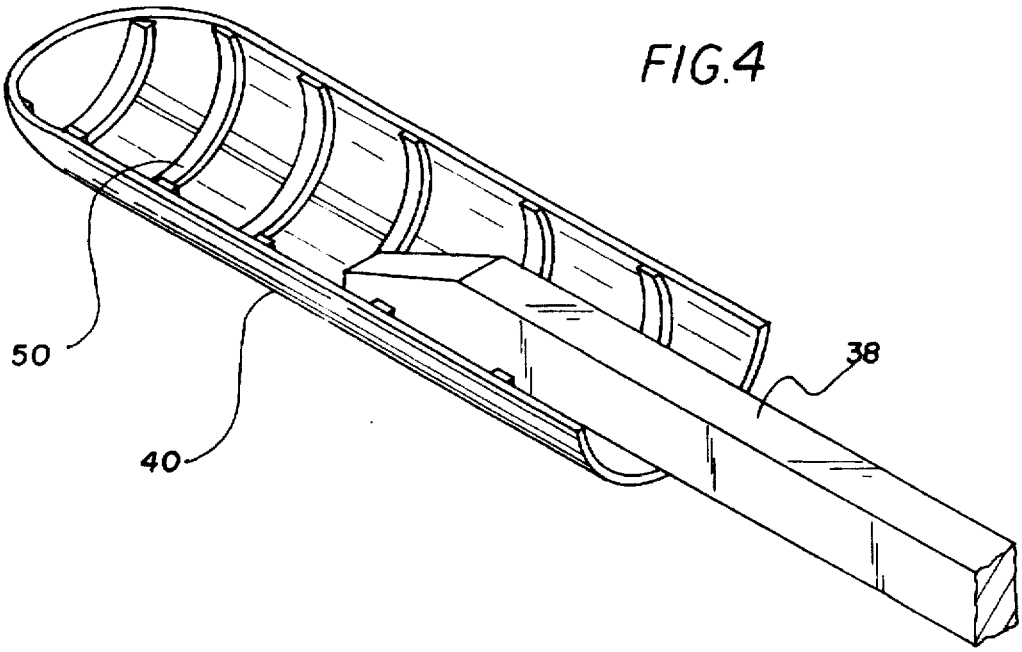
FIG. 4 is a perspective view of one of the retractable prongs of the present invention.
Figure 5:
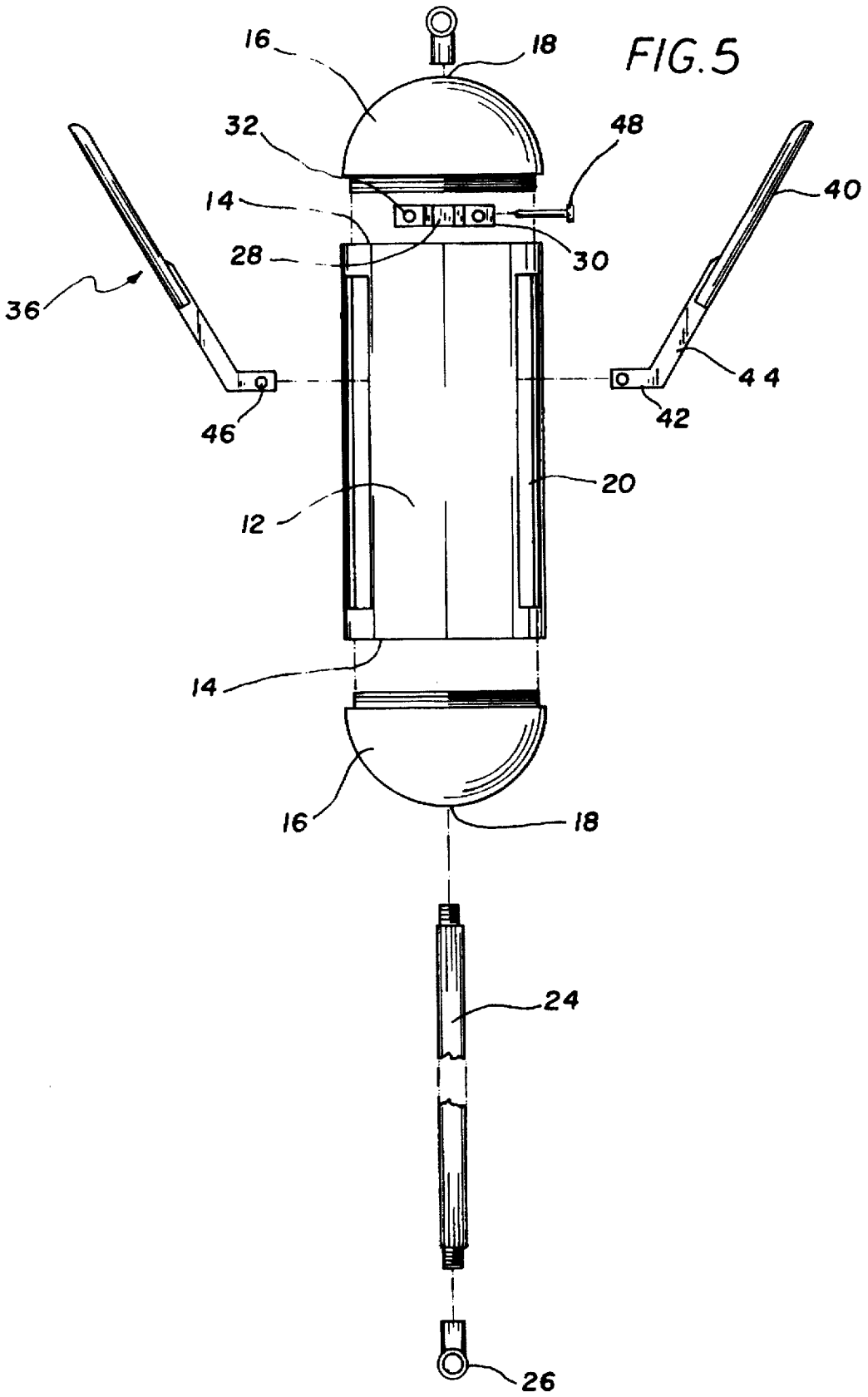
FIG. 5 is an exploded front view of the present invention.

With reference now to the drawings, and in particular, to FIGS. 1 through 5 thereof, the preferred embodiment of the new and improved anchor having release capabilities embodying the principles and concepts of the present invention and generally designated by the reference number 10 will be described.

Specifically, it will be noted in the various Figures that the device relates to a anchor having release capabilities for allowing the anchor to be recovered should it become snagged or wedged on a bottom of a lake and the like. In its broadest context, the device consists of a cylindrical housing, a central post, three pivoting prongs, a main line and a secondary monofilament line. Such components are individually configured and correlated with respect to each other so as to attain the desired objective.

The device 10 includes a cylindrical housing 12 having open end portions 14. Each of the open end portions 14 have a rounded end cap 16 removably coupled therewith. Each of the end caps 16 have an aperture 18 therethrough. The cylindrical housing 12 has three equidistantly spaced vertical slots 20 therein. The cylindrical housing 12 in constructed of a durable metal material and having sufficient weight to act in manner suitable for an anchor.

Next, the device 10 includes a central post 24 having a length greater than a length of the cylindrical housing 12. The central post 24 slidably extends through the apertures 18 of the end caps 16. Free ends of the central post 24 have cable eyes 26 disposed thereon. The central post 24 has a three way bracket 28 secured thereto. The three way bracket 28 has tabs 30 extending outwardly towards corresponding vertical slots 20 of the cylindrical housing 12. The tabs 30 each have an aperture 32 therethrough.

The device 10 also includes three pivoting prongs 36 each having an interior portion 38 and an exterior portion 40. Each interior portion 38 has an inner segment 42 and an outer segment 44 whereby the inner segment 42 is angularly disposed with respect to the outer segment 44. The inner segment 42 of each prong 36 extends inwardly of the three vertical slots 20 of the cylindrical housing 12. The inner segment 42 has an aperture 46 therethrough for aligning with the apertures 32 of the tabs 30 of the three way bracket 28 for pivotal securement thereto. The pivotal securement is facilitated through the use of a locking pin 48. The exterior portion 40 is defined by an elongated arcuate member having a plurality of ridges 50 disposed on its lower surface.

A main line 54 is included having a free end secured to one of the cable eyes 26 of the central post 24. An opposing free end of the main line 54 is adapted for coupling to a boat. The main line 54 is used to remove the anchor from the water during normal usage.

Lastly, a secondary monofilament line 58 is included having a first end coupled to one of the cable eyes 26 of the central post 24 opposed from the main line 54. A second end of the secondary monofilament line 58 is secured to the main line 54. When the anchor is caught on rough terrain, a pulling force of about thirty pounds will cause the secondary monofilament line 58 to break thereby causing the main line 54 to flip the anchor over. This action will cause the central post 24 to be pulled forward thereby retracting the three pivoting prongs 36 into the three recesses 20. This will enable the device 10 to be pulled free from the rough terrain or other obstruction and pulled back onto the boat. A replacement secondary monofilament line 58 is then replaced and the device 10 can be returned to the water.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. An anchor having release capabilities for allowing the anchor to be recovered should it become snagged or wedged on a bottom of a lake and the like comprising, in combination:

a cylindrical housing having open end portions, each of the open end portions having a rounded end cap removably coupled therewith, each of the end caps having an aperture therethrough, the cylindrical housing having three equidistantly spaced vertical slots therein;

a central post having a length greater than a length of the cylindrical housing, the central post slidably extending through the apertures of the end caps, free ends of the central post having cable eyes disposed thereon, the central post having a three way bracket secured thereto, the three way bracket having tabs extending outwardly towards corresponding vertical slots of the cylindrical housing, the tabs each having an aperture therethrough;

three pivoting prongs each having an interior portion and an exterior portion, each interior portion having an inner segment and an outer segment whereby the inner segment is angularly disposed with respect to the outer segment, the inner segment of each prong extending inwardly of the three vertical slots of the cylindrical housing, the inner segment having an aperture therethrough for aligning with the apertures of the tabs of the three way bracket for pivotal securement thereto, the exterior portion being defined by an elongated arcuate member having a plurality of ridges disposed on its lower surface;

a main line having a free end secured to one of the cable eyes of the central post, an opposing free end of the main line adapted for coupling to a boat; and a secondary monofilament line having a first end coupled to one of the cable eyes of the central post opposed from the main line, a second end of the secondary monofilament line secured to the main line.

2. An anchor having release capabilities comprising:

a cylindrical housing having a plurality of equidistantly spaced vertical slots therein;

a central post slidably extending through the cylindrical housing, free ends of the central post having cable eyes disposed thereon;

a plurality of pivoting prongs extending inwardly of the plurality of vertical slots of the cylindrical housing for pivotal securement to the central post;

a main line having a free end secured to one of the cable eyes of the central post, an opposing free end of the main line adapted for coupling to a boat; and a secondary line having a first end coupled to one of the cable eyes of the central post opposed from the main line, a second end of the secondary monofilament line secured to the main line.

3. The anchor as set forth in claim 2 wherein the cylindrical housing having open end portions, each of the open end portions having a rounded end cap removably coupled therewith, each of the end caps having an aperture therethrough for slidably receiving the central post therethrough.

4. The anchor as set forth in claim 2 wherein the central post having a bracket secured thereto for pivotal coupling with the plurality of prongs.

5. The anchor as set forth in claim 4 wherein the bracket having a plurality of tabs extending outwardly towards corresponding vertical slots of the cylindrical housing for coupling with the prongs.

6. The anchor as set forth in claim 2 wherein the pivoting prongs each having an interior portion and an exterior portion, each interior portion having an inner segment and an outer segment whereby the inner segment is angularly disposed with respect to the outer segment, the inner segment of each prong extending inwardly of the vertical slots of the cylindrical housing for pivotal securement to the central post.

7. The anchor as set forth in claim 6 wherein the exterior portion of the plurality of prongs being defined by an elongated arcuate member having a plurality of ridges disposed on its lower surface.

* * * * *